US010709205B2

(12) United States Patent
Harris

(10) Patent No.: US 10,709,205 B2
(45) Date of Patent: Jul. 14, 2020

(54) SHOE LACE LOCK AND SYSTEM AND METHOD FOR LACING SHOES

(71) Applicant: XPAND INC., Toronto (CA)

(72) Inventor: Charles David Harris, Anacortes, WA (US)

( * ) Notice: Subject to any disclaimer, the term of this patent is extended or adjusted under 35 U.S.C. 154(b) by 0 days.

(21) Appl. No.: 15/932,560

(22) Filed: Mar. 13, 2018

(65) Prior Publication Data

US 2018/0255878 A1 Sep. 13, 2018

Related U.S. Application Data

(60) Provisional application No. 62/601,184, filed on Mar. 13, 2017.

(51) Int. Cl.

| | |
|---|---|
| ***F16G 11/00*** | (2006.01) |
| ***A43C 7/00*** | (2006.01) |
| ***A43C 1/02*** | (2006.01) |
| *A41D 3/00* | (2006.01) |

(52) U.S. Cl.

CPC ..... *A43C 7/00* (2013.01); *A43C 1/02* (2013.01); *A41D 3/00* (2013.01); *A41D 2300/22* (2013.01)

(58) Field of Classification Search

CPC ..... A43C 7/00; A43C 1/02

See application file for complete search history.

(56) References Cited

U.S. PATENT DOCUMENTS

| | | | | | |
|---|---|---|---|---|---|
| 268,407 | A | * | 12/1882 | Hughes | A61B 17/132 606/203 |
| 329,071 | A | * | 10/1885 | Palmer | F16G 11/00 24/129 R |
| 630,837 | A | * | 8/1899 | Anderson | F16G 11/00 24/129 R |
| 666,400 | A | * | 1/1901 | Tregoning | F16G 11/103 24/129 R |
| 947,111 | A | * | 1/1910 | Lorentz | F16G 11/00 24/115 G |
| 966,297 | A | * | 8/1910 | Bart | F16G 11/00 24/115 J |
| 1,407,406 | A | * | 2/1922 | Glazebrook | B66C 1/12 24/129 R |
| 1,426,537 | A | * | 8/1922 | Bauer | F16G 11/14 24/130 |
| 1,452,338 | A | * | 4/1923 | Flowers | F16G 11/14 24/130 |
| 1,583,343 | A | * | 5/1926 | Duerden | F16G 11/14 24/129 R |
| 1,896,705 | A | * | 2/1933 | Geisenhoner | F16G 11/046 24/115 R |

(Continued)

*Primary Examiner* — Jason W San

(74) *Attorney, Agent, or Firm* — Todd N. Hathaway

(57) ABSTRACT

A cord lock device is provided, which includes a body having first and second faces, with a cord passage extending through the body between the first and second faces. First and second grip channels are formed in the first face and have respective first ends adjacent to the cord passage and second ends extending away from the cord passage. Each of the grip channels has a pair of grip teeth facing each other on opposite sides of the respective grip channel, ridges of the pairs of grip teeth extending from the first face toward the second face at an angle such that at the first face, the ridges are furthest from the cord passage, while at a point closest to the second face, the ridges are closest to the cord passage.

10 Claims, 5 Drawing Sheets

(56) References Cited

U.S. PATENT DOCUMENTS 2,271,288 A * 1/1942 Cuff ..... D06F 53/00 24/130
2,592,696 A * 4/1952 Hoody ..... A63H 33/00 24/115 F
2,870,506 A * 1/1959 Hudkins ..... F16G 11/046 24/129 R
2,884,674 A * 5/1959 Neuberger ..... D06F 53/00 24/129 R
2,903,772 A * 9/1959 McKinlay ..... F16G 11/046 24/129 R
2,932,072 A * 4/1960 Pruchnow ..... D06F 53/04 188/65.1
3,221,383 A * 12/1965 Bilodeau ..... F16G 11/02 24/130
3,289,260 A * 12/1966 Buscall, Jr. ..... H01B 17/16 174/208
3,309,745 A * 3/1967 Gintz ..... H02G 7/056 174/79
3,409,014 A * 11/1968 Shannon ..... A61B 10/04 24/129 B
D218,515 S * 8/1970 Tomaiuolo ..... 24/30.5 R
3,721,750 A * 3/1973 Countryman ..... A44B 11/02 174/135
3,930,288 A * 1/1976 Black ..... B66C 1/12 24/129 R
3,953,144 A * 4/1976 Boden ..... F16G 11/101 403/374.2
4,034,443 A * 7/1977 Turner ..... F16G 11/14 24/129 R
4,105,349 A * 8/1978 Kupperman ..... F16G 11/14 24/129 R
4,222,157 A * 9/1980 Forman ..... F16G 11/103 24/129 A
4,414,712 A * 11/1983 Beggins ..... B63B 21/00 114/218
4,648,159 A * 3/1987 Dougherty ..... A41F 1/04 24/129 R
D289,373 S * 4/1987 Kimball ..... 24/130
4,665,590 A * 5/1987 Udelhofen ..... F16G 11/101 24/115 H
4,788,755 A * 12/1988 Kasai ..... A45C 13/30 24/136 A
4,790,048 A 12/1988 Arnt
4,838,499 A * 6/1989 Fohl ..... B60R 22/4619 242/153
4,878,269 A * 11/1989 Anscher ..... F16G 11/101 24/115 G
4,919,370 A * 4/1990 Martin ..... F16L 5/00 174/153 G
5,027,478 A * 7/1991 Suhr ..... B65H 75/36 137/355.16
5,054,636 A * 10/1991 Netzer ..... B65D 67/02 206/504
D323,103 S * 1/1992 Hilmersson ..... D8/356
5,158,428 A * 10/1992 Gessner ..... A43C 1/003 24/712.1
5,193,252 A * 3/1993 Svehaug ..... E04H 15/32 24/115 G
5,214,863 A 6/1993 Skaja
5,232,193 A * 8/1993 Skakoon ..... A61M 5/1418 24/130
5,245,729 A * 9/1993 Greff ..... F16G 11/046 24/129 R
5,261,343 A * 11/1993 Elterman ..... B63B 21/045 114/218
5,339,498 A * 8/1994 Parsons ..... B63B 21/08 24/115 M
5,572,770 A * 11/1996 Boden ..... F16G 11/101 24/136 R
5,625,925 A * 5/1997 Richards ..... B60P 7/0823 24/129 B
5,660,133 A * 8/1997 Munich ..... B63B 59/02 114/218
5,894,639 A * 4/1999 Boden ..... F16G 11/106 24/115 G
6,095,282 A * 8/2000 Sadeck ..... A62B 1/04 182/191
6,148,489 A 11/2000 Dickie et al.
6,185,798 B1 * 2/2001 Ton ..... A43C 7/08 24/115 G
6,381,816 B1 * 5/2002 Lai ..... A43C 7/00 24/130
6,401,309 B1 * 6/2002 Yang ..... F16G 11/046 24/115 H
6,457,214 B1 * 10/2002 Boden ..... F16G 11/101 24/115 M
6,735,829 B2 * 5/2004 Hsu ..... A43C 3/00 24/130
6,880,788 B2 * 4/2005 Stephen ..... F16B 35/041 174/53
6,922,917 B2 8/2005 Kerns et al.
7,243,399 B2 * 7/2007 Liao ..... B65D 63/14 24/129 A
7,281,341 B2 10/2007 Reagan et al.
7,353,766 B1 * 4/2008 Wiese ..... B63B 21/045 114/218
7,530,990 B2 * 5/2009 Perriello ..... A61B 17/0401 606/232
7,686,830 B2 * 3/2010 Collier ..... A61B 17/0401 606/232
7,722,644 B2 * 5/2010 Fallin ..... A61B 17/0401 24/129 R
7,806,909 B2 * 10/2010 Fallin ..... A61B 17/0487 24/129 A
7,833,227 B2 * 11/2010 Fernandez ..... A61B 17/82 606/74
8,291,562 B2 * 10/2012 Webb ..... A01D 80/02 24/129 R
8,371,004 B2 * 2/2013 Huber ..... A43B 5/0401 24/132 R
8,388,655 B2 * 3/2013 Fallin ..... A61B 17/0401 24/129 R
8,864,797 B2 * 10/2014 Justin ..... A61B 17/0487 606/232
D737,502 S * 8/2015 Kirkham ..... D26/143
9,168,044 B2 * 10/2015 Kirkham ..... A61B 17/1322
9,185,948 B2 * 11/2015 Ben-Arie ..... A43C 7/04
9,241,748 B2 * 1/2016 Bernstein ..... A61B 17/82
D758,175 S * 6/2016 Symons ..... D8/383
9,409,437 B2 * 8/2016 Green ..... B43K 29/02
9,791,102 B2 * 10/2017 Moreau ..... A44C 11/005
10,039,347 B2 * 8/2018 Spanks ..... A43C 11/14
2005/0102861 A1 5/2005 Martin
2006/0000063 A1 * 1/2006 Lundstedt ..... F16G 11/103 24/129 R
2006/0143940 A1 7/2006 Wiper
2006/0191164 A1 8/2006 Dinndorf et al.
2008/0216351 A1 9/2008 Carroll et al.
2009/0282653 A1 * 11/2009 Yang ..... A43C 7/00 24/129 R
2010/0160957 A1 * 6/2010 Kirkham ..... A61B 17/1322 606/203
2012/0284976 A1 11/2012 Cox
2013/0145582 A1 * 6/2013 Chupp ..... F16G 11/12 24/129 R
2013/0160256 A1 6/2013 Waldman et al.
2014/0196256 A1 * 7/2014 Garcia ..... F16G 11/046 24/129 R
2015/0223569 A1 8/2015 Cox
2015/0224009 A1 * 8/2015 Cedrone ..... F16M 13/04 128/845
2016/0108989 A1 * 4/2016 Symons ..... A43C 7/06 24/136 R
2019/0208866 A1 * 7/2019 Dietrich ..... F16G 11/10

* cited by examiner

SHOE LACE LOCK AND SYSTEM AND METHOD FOR LACING SHOES

CONTINUING INFORMATION

This application claims the priority of U.S. Provisional Patent Application Ser. No. 62/601,184 filed Mar. 13, 2017.

BACKGROUND a. Field of the Invention

The present invention relates generally to laces for shoes, boots and other articles of footwear, and, more particularly to a lock piece having first and second channels that allow the ends of an elastomeric shoelace to be drawn therethrough as a user applies tension, but that grip and hold the lace ends fast against loosening when released by the user.

b. Related Art

It has been common practice from time immemorial to pull on the ends of a shoelace in order to cinch a shoe or other article of footwear about the foot, and then tie the ends together to prevent the lace from loosening. As used herein, the terms "shoe" and "shoes" include shoes, boots and other articles of footwear, as well as other articles that are similarly tightened about the foot and/or limb, and the terms "lace" and "laces" include the elongate, flexible cords that are routed through the eyelets or the corresponding structures of the shoe for synching and tightening the shoe on the foot and/or other part of the body of the user.

Although time-honored, the traditional approach of tensioning and then tying shoelaces presents a number of drawbacks. •Although simple enough for most people, the task is still tedious and frequently annoying, especially when the knots accidentally undo and the laces go loose, typically at a most inopportune time. For many people, however, the task can present a much greater challenge. For example, many people experience impaired dexterity in their hands and fingers, in some cases due to advanced age but in others as a result of disease, trauma, neurological/muscular skeletal conditions (e.g., arthritis, dyskinesia, Parkinson's disease) or side effects of drugs or substances. For such individuals, the act of tying an untying a knot in a shoelace may prove frustrating or even impossible.

Furthermore, loose shoelaces commonly create a trip hazard that can lead to a fall, which can have serious consequences for anyone, but even more so for those engaged in running and other athletic activities. Furthermore, an untied shoelace may present grave consequences if the wearer is engaged in a high risk activity, such as work in a hazardous environment (e.g., around rotating or moving equipment), climbing/working at heights, or engaged in law enforcement/firefighting activities/military activities.

Such drawbacks of tying laces in the conventional manner have not gone unnoticed. A number of devices have been provided or proposed for the purpose of securing the ends of shoelaces and holding them tight without having to tie a knot. Some have achieved a degree of success, yet retain certain deficiencies. Many have been multi-piece devices featuring moving jaws, clasps, spring-loaded plungers, cooperating pieces with openings that slide in-and-out of register, and so on: Particular drawbacks of such devices include complexity, with the associated potential for wear/failure of the moving parts and cost of manufacture, the latter of critical importance in such a small accessory. Also, these devices commonly require the user to carefully thread the lace ends back-and-forth through the parts, and many also require the user to maintain continuous finger pressure against a spring-loaded plunger or other part while tensioning and/or releasing the laces, both of which are potentially problematic for persons having compromised finger strength or dexterity. Even for those having ordinary finger strength, the force of the spring or other biasing member must be kept below a certain maximum, in order to be operable within the limits of a normal hand/fingers with the result that the various clamping and kinking mechanisms of such devices are frequently unable to generate sufficient grip to hold the lace ends against slipping.

While some prior devices have employed one-piece construction, many of those have still required that the laces be routed back-and-forth, in a manner that is tedious and time-consuming at best and potentially impossible for those with compromised dexterity/strength. Furthermore, many share the problem of generating insufficient grip to prevent the lace ends slipping under tension.

Accordingly, there exists a need for an apparatus and method by which a user can tension the ends of a shoelace so as to tighten the shoelace to the desired extent, and then release the ends of the shoelace while the lace is still kept tight, without the device employing multiple/moving parts and without the associated costs and potential for wear/failure. Furthermore there exists a need for such an apparatus and method that does not require the lace ends to be routed back-and-forth through various openings, and requires only minimal hand/finger dexterity and strength on the part of the user. Still further, there exists a need for such an apparatus and method that reliably holds the shoelace fast at the desired tension without potential for accidental slippage and loosening of the lace. Still further, there exists a need for such an apparatus and method that allows the user to release the tension on the shoelace in order to loosen the shoe when desired, in a quick and convenient manner and again with only minimal finger/hand strength and dexterity.

SUMMARY OF THE INVENTION

The present invention addresses the problems cited above, and provides a one-piece lace lock having grip channels that engage and release elastic shoelaces quickly and conveniently with a simple movement of one hand while holding on the ends of the lace with the other hand, and consequently requires only minimal strength and dexterity on the part of the user.

Broadly, the invention provides a one-piece lace anchor for use with an elastomeric shoelace having a predetermined size, comprising: (a) a body having forward and rearward ends and upper and lower sides; (b) a tab portion on the forward end of the body, the tab portion being configured to receive downward pressure from a thumb or finger of a first hand of a user; (c) first and second grip channels on the rearward end of the body that receive first and second ends of the elastic shoelace therein, the grip channels each having at least one set of opposing ridges that project into the grip channel so as to form a reduced size gap between the ridge; and (d) at least one lace passage that extends from the lower surface to the upper surface through a middle portion of the body intermediate the tab portion on the forward end and the grip channels on the rearward end, the through passage being sized to permit the first and second lace ends to pass upwardly from the shoe therethrough in side-by-side relationship and having first and second laterally spaced apart ends located generally proximate forward entrances of said first and second grip channels; (e) the reduced-sized gap between the opposing pairs of ridges in the grip channels being selected relative to the predetermined size of the elastomeric shoelace such that: (i) when the lace end is stretched to a reduced diameter the gap between the ridges is sufficiently large to release the lace ends to allow the lace ends to slide through the grip channels as the user pulls the lace end to tighten the shoelace; and (ii) when the lace end is slacked to expand to an original diameter the reduced-diameter gap between the ridges is sufficiently small to engage the lace ends to prevent the lace ends from sliding through the gap channels in a manner that would loosen the shoelace.

The opposed pairs of ridges in the grip channels may comprise opposed pairs of ridges having sharply pointed edges that press into the material of the lace ends so as to create bulges in the untensioned portions of the lace ends in the grip channels. The opposing pairs of ridges may extend at downward and forward angles in the grip channels, so that in response to tension applied in a forward direction to the lace ends, from the shoe through the lace ends extending through the passage in the lace lock, the first and second lace ends are drawn downwardly and deeper into the grip channels. The opposed ridges may comprise opposed ridges that converge to narrow the reduced-size gaps towards bottoms of the grip channels, so that the edges of the ridges press further into engagement with the lace ends in response to the lace ends being drawn deeper into the grip channels. The pairs of opposed ridges may comprise a plurality of pairs of opposed ridges in each of the channels.

The ends of the lace passage through the middle portion of the body of the lace lock may be located closely adjacent or contiguous with the forward entrances of the grip channels. The lace passage may comprise a guide surface on the rearward side of the passage that is contoured to separate and direct the lace ends towards the ends of the passage in response to application of tension to the lace ends. The guide surface of the lace passage may comprise a forwardly convex surface, over which the lace ends slide apart in response to tension applied to the lace ends from the lace passage toward the grip channels. The forwardly convex guide surface may be a rearward surface of an arcuately curved slot that is dimensioned to receive the two lace ends in close-fitting relationship therewith so as to prevent the lace ends from overlapping or binding within the passage.

The tab portion on the forward end of the body of the lace lock may comprise an upwardly and forwardly sloped upper surface configured to be engaged under the thumb of a user. The rearward end of the body of the lace lock may in turn comprise the lower surface configured to be engaged atop a finger of the same hand of the user. The lace lock may be held between the thumb and the finger of the user's first hand, while the lace ends are tensioned by the user's second hand. The forward end of the body of the lace lock may be pressed or held downwardly by the thumb while the rearward end is pressed or held upwardly by the finger, so that the rearward end of the lace lock pivots in an upwardly direction relative to the lace ends in a downward direction deeper into the grip channels.

The lace lock may be formed as a unitary piece of material, such as an injection molded plastic material.

These and other features and advantages of the invention will be more fully appreciated from a reading of the following detailed description with reference to the accompanying drawings.

DETAILED DESCRIPTION

Figure 1:
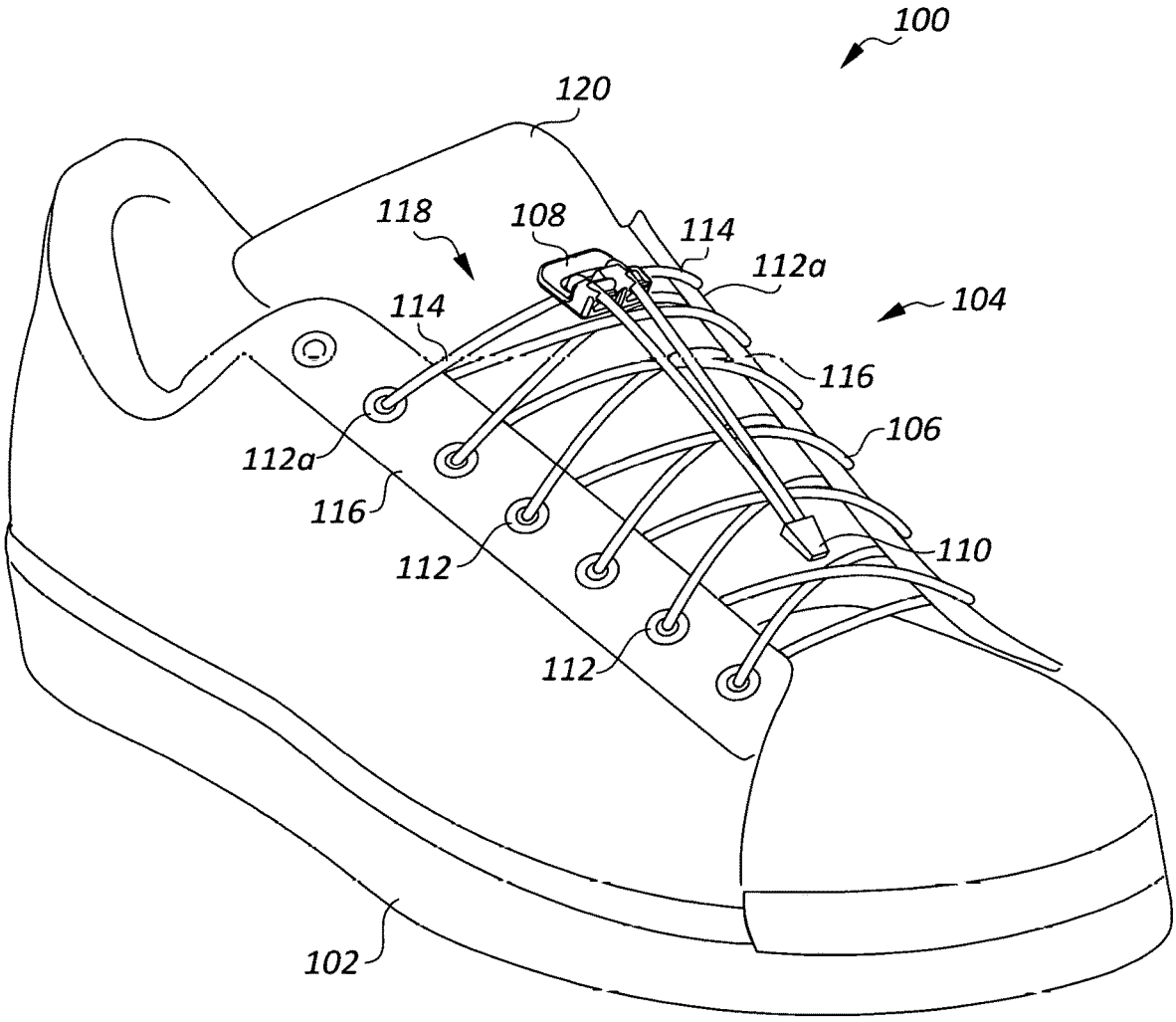
FIG. 1 is a perspective view of a shoe assembly including a lace lock according to an embodiment of the invention.

In the following detailed description, reference is made to the accompanying drawings, which form a part hereof. In the drawings, similar reference characters typically identify similar components, unless context dictates otherwise. Other embodiments may be used and/or other changes may be made without departing from the spirit or scope of the disclosure. For ease of understanding, the terms "forward," "front," "rearward," "back" and the like, as used in this description, refer respectively to the directions or relative locations proximal (towards) and distal (away) from the perspective of a user wearing a shoe or other article of footwear (i.e., the forward end is towards the ankle and the rearward end is towards the toes); similarly the terms "upper," "top" and "lower," "bottom" refer to the dorsal and plantar directions from the perspective of such a user.

FIG. 1 is a perspective view of a shoe assembly 100, according to an embodiment, which includes a shoe 102 and a lacing system 104. The lacing system includes a shoelace 106, a lace lock 108, and an end cap 110. The shoe includes a plurality of eyelets 112 through which the shoelace 106 is threaded in one of a number of well-known lacing patterns. In the embodiment shown, the shoelace 106 is threaded such that the shoelace ends 114 pass out through the last eyelets 112*a* from the tops of the respective eye stays 116. This positions the lace lock 108 somewhat above the shoelace 106 in the throat 118 of the shoe 102. Alternatively, the shoelace 106 can be laced such that the shoelace ends 114 exit the last eyelets 112*a* from the underside of the respective eye stays 116, which positions the lace lock 108 in a lower position between the eye stays 116 and closer to the tongue 120. Depending upon the circumstances, one or the other of these two arrangements may be advantageous. However, the particular lacing pattern used is a matter of user preference, and any suitable pattern can be used. According to an embodiment, the shoelace 106 is made of round elastic cord—similar to those commonly referred to as shock cords, or bungee cords, but having diameter, length and elasticity suitable for use as shoelaces. Without limitation, typical examples of such laces have a diameter of around 2.5-3 mm and are capable of stretching to about 150-175% of their un-tensioned length, and are generally cut to lengths between about 20 and 84 inches depending on shoe size and type, number of eyelets and other factors.

The term last eyelets is used here to refer to the eyelets 112*a* that are closest, along the length of the shoelace 106, to the shoelace ends 114. In many cases, these will be the uppermost eyelets 112, but this is not always the case, as illustrated in the example of FIG. 1.

The lace lock 108 is configured to receive the lace ends 114 and hold them at a selected length. In operation, a user threads the shoelace 106 in the eyelets 112 in a selected pattern, then threads the ends 114 into the lace lock 108, as described in more detail below, with reference to FIGS. 4 and 5. While wearing the shoe 102, the user draws the laces 106 to a comfortable tension and holds or slides the lace lock 108 along the ends 114 to a position approximately between the last eyelets 112*a*. The user then engages the lace lock 108, which grips the ends 114 of the shoelace 106, preventing the shoelace ends 114 from sliding back and relieving the tension. The user may then cut the shoelace ends 114 to a convenient length, and optionally bind the tips together using an end cap 110, as shown in FIG. 1, or by tying a knot. Endcaps are very well known in the art, being commonly used to bind the ends of a length of shock cord, to form a loop, and so on.

When the user desires to remove the shoe, the shoelace ends 114 can be released from the lace lock 108, permitting the extreme ends of the shoelace to slide back through the lace lock 108 until the end cap 110 reaches the lace lock, substantially releasing the tension and loosening the shoe assembly 100 while the end cap 110 prevents the lace lock from being separated from the shoelace.

Depending upon the tension selected by the user, and the characteristics of the shoelace 106, the shoelace 106 may retain sufficient residual resiliency while tensioned to enable the user to remove and re-don the shoe 102 without releasing the lace lock 108, such that the shoelace need only be tightened and locked once. In other applications, the user may desire a more secure attachment—requiring a higher shoelace tension—or at least a lower residual resiliency, necessitating the release of the lace lock 108 prior to removal of the shoe. This may be the case, for example, when the lacing system 104 is employed with athletic shoes, hiking or climbing shoes, boots, military footwear, and other footwear intended for strenuous and/or high-risk activities.

Figure 2A:
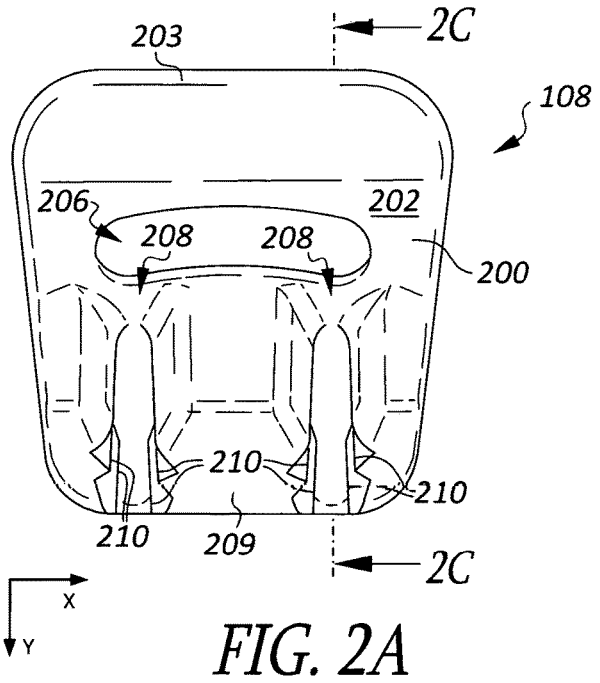
FIG. 2A is a plan view of the lace lock of the shoe assembly FIG. 1, according to an embodiment.
Figure 2B:
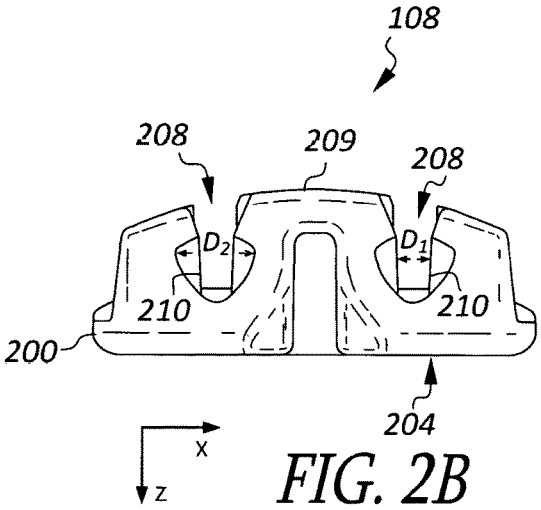
FIG. 2B is a rear elevational view of the lace lock of FIG. 2A.
Figure 2C:
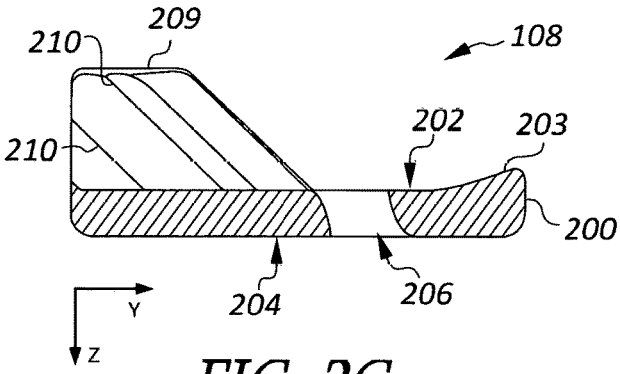
FIG. 2C is a side sectional view of the lace lock of FIG. 2A, taken along lines 2C-2C in FIG. 2A.
Figure 2D:
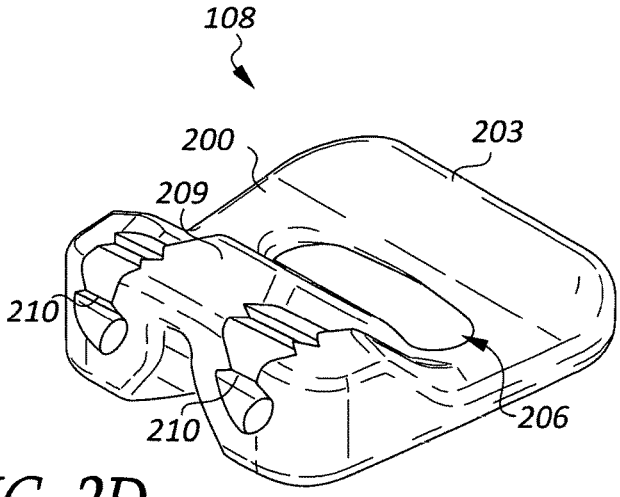
FIG. 2D is a perspective view of the lace lock of FIG. 2A.

Turning now to FIGS. 2A-2D, the lace lock 108 is shown in detail. FIG. 2A is a plan view of lace lock 108, FIG. 2B is a rear elevation view, FIG. 2C is a side sectional view of the lace lock, taken along lines 2C-2C of FIG. 2A, and FIG. 2D is a perspective view of the lace lock 108. For the purposes of clarity in the use of directional/positional terms in the description that follows, it can be assumed that the lace lock 108 is oriented substantially as shown in FIG. 1, although no such limitation is implied with respect to the claims or the use of such a device in actual practice.

The lace lock 108 can be molded or otherwise formed as a single piece, with a body 200 having an upper face 202 and a lower face 204. In the embodiment pictured, the lower face 204 is substantially planar, while a portion of the upper face 202 lies parallel to the lower face. Another portion of the upper face 202 slopes upwardly at the front to form a raised surface over a somewhat thickened tab portion 203. A cord passage 206 extends through the body 200 between the upper and lower faces 202, 204; in the illustrated embodiment, the cord passage 206 has an arcuate shape in plan view, although in other embodiments the cord passage may have other shapes and configurations.

A pair of generally parallel grip channels 208*a-b* is formed on the upper face 202 of the lace lock 108 in a raised area towards the rearward end. Each of the grip channels 208 includes a respective front end and back end defining longitudinal axes. The front, entrance ends of the grip channels 208 are positioned adjacent to respective ends of the arcuate cord passage 206, and a prominence 209 is defined by the raised surface between the grip channels, defining the uppermost portion of the lace lock 108. The grip channels 208 are open to the surface of the upper face 202 along their respective lengths, which permits cord or lace to be introduced into the channels from above.

Each of the grip channels 208 includes one or more opposing, inwardly projecting pairs of grip teeth 210. A narrowest transverse dimension $D_1$ is defined in each of the grip channels 208 by opposing ridges of a pair of the grip teeth 210. Likewise, a widest transverse dimension $D_2$ is defined by a pair of opposing valleys 214 adjacent to a pair of grip teeth within each of the grip channels 208. This relationship is most clearly visible in FIG. 2B, wherein the dimensions $D_1$ and $D_2$ are identified. In some embodiments, a rearmost pair of a set of grip teeth 210 defines the narrowest transverse dimension $D_1$, as in the case of the embodiment of FIGS. 2A-2D. Other embodiments are contemplated, in which others of a plurality of pairs of grip teeth define the narrowest transverse dimension, or in which a same dimension is defined between multiple pairs of teeth.

According to an embodiment, the transverse distance of the gap between each pair of grip teeth 210 varies along the length and depth of each pair of teeth, as described below with reference to the embodiment shown in FIGS. 6A-6D.

Referring in particular to the side-sectional view of FIG. 2C, it can be seen that the grip teeth 210 are angled with respect to a horizontal, transverse plane of the body of the lace lock, as defined in the illustrated embodiment by the lower face 204 of the body 200. Specifically, the grip teeth 210 have a forward/downward, rearward-upward slope, i.e., the ridges of the teeth are closest to the front of the lace lock 108 at the point where the teeth terminate against the upper face 202 of the body 200.

Figure 3A:
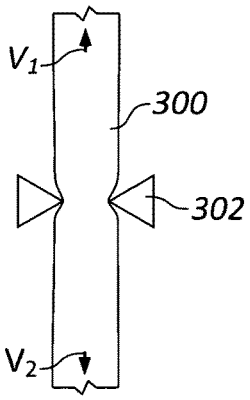
FIGS. 3A-3C illustrate characteristics of elastomeric materials under respective different conditions.
Figure 3B:
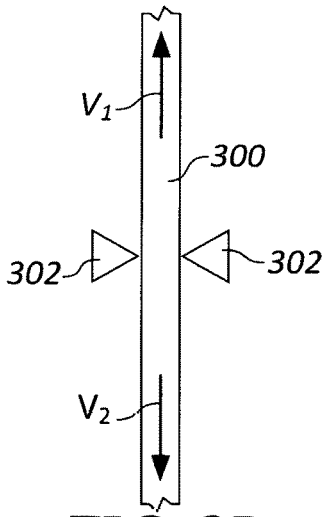
Figure 3C:
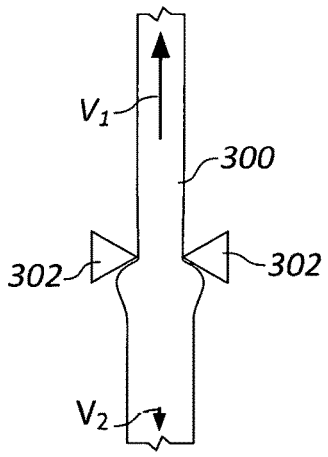

FIGS. 3A-3C illustrate characteristic behavior of an elastomeric element 300 positioned between a pair of fixed ridges 302 and configured to receive tensioning forces at opposite ends, applied along respective opposing vectors $V_1$, $V_2$. In FIG. 3A, there is little or no force applied to the elastomeric element 300, which is therefore in a substantially relaxed, or un-tensioned state. The distance separating the ridges 302 is smaller than a transverse dimension (e.g., diameter) of the elastomeric element 300 in its relaxed state. Accordingly, indentations are formed in the elastomeric element 300 by the ridges 302.

In FIG. 3B, substantially equal tensioning forces are applied to the elastomeric element 300 along the opposing vectors $V_1$, $V_2$, causing the element to become elongated. As the elastomeric element 300 is stretched, its transverse dimension is reduced, until the transverse dimension is about equal to or slightly less than the distance separating the ridges 302. In this condition, the elastomeric element 300 can be moved longitudinally through the gap between the ridges with little or no resistance.

In FIG. 3C, a tensioning force is applied to the elastomeric element 300 along the vector $V_1$ while little or no force is applied along the opposing vector $V_2$. The result is that a bulge forms in the elastomeric element 300 on the side of the ridges 302 opposite the source of the tensioning force. The result is that the ridges 302 form an engagement that resists longitudinal translation of the elastomeric element 300. The degree to which movement of the elastomeric element 300 is resisted is controlled by factors such as, for example, the transverse dimension of the elastomeric element while in its relaxed state relative to the separation distance of the ridges 302, the specific geometry of the fixed ridges 302, the durometer of the material of the elastomeric element, the relative values of forces applied along the opposing vectors $V_1$, $V_2$, etc.

As noted with reference to the embodiment of FIG. 1, a suitably sized shock cord is a preferred material for the shoelace 106. This type of cord has a core comprising a plurality of strands of an elastomeric material—e.g., natural or synthetic rubber—that is bound inside a sheath or tube of woven material, typically cotton or nylon. The degree of force required to stretch the cord is a function of the durometer and total cross-sectional area of the elastomeric core. In some cases, the woven sheath is designed to limit the maximum length to which the cord can be stretched. Typical shock cord has characteristics that are substantially similar to those described with reference to FIGS. 3A-3C, i.e., when tension is applied to the cord, the elastomeric core stretches, while its transverse diameter reduces, and when the cord is confined within a restricting passage, longitudinal force, applied unevenly to opposing ends, will result in resistance to translation of the cord.

Figure 4:
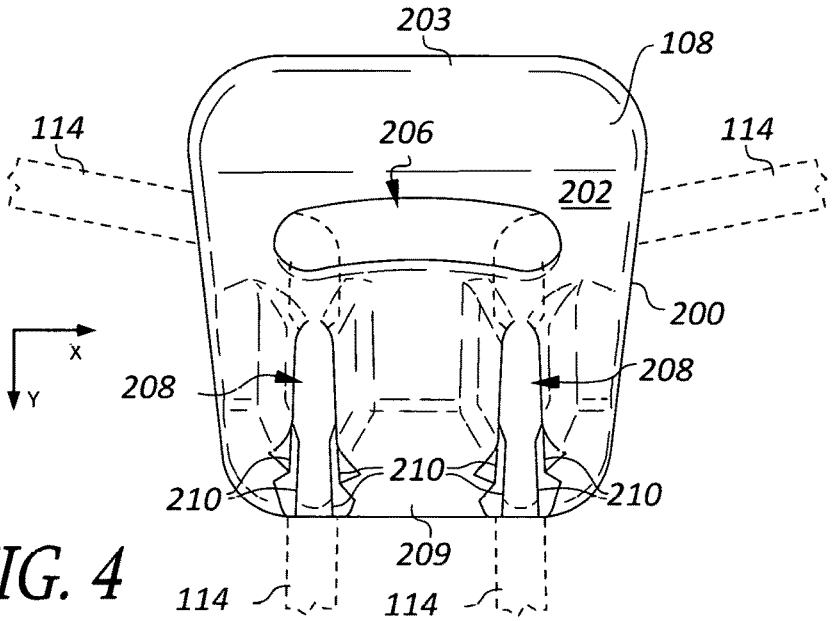
FIG. 4 is a plan view of a lace lock of FIGS. 1-2D, showing the device in locking engagement with the ends of elastic shoelaces.

FIG. 4 is a plan view of a lace lock 108 described with reference to FIGS. 1-2D, showing the device engaging ends 114 of a shoelace, according to an embodiment. The ends 114 extend from the last eyelets 112*a* (as shown in FIG. 1) on opposite sides of the lace lock 108, and pass from under the lace lock through the cord passage 206, exiting the cord passage at the upper face 202 of the body immediately adjacent to the respective forward ends of the grip channels 208. Ends 114 then extend into the grip channels 208 from the forward ends, exiting from the back ends of the grip channels. It will be noted that the cord passage 206 is the only opening through which the user (or a caregiver) must thread the laces, and that the passage is relatively wide and allows both lace ends to be pushed through at the same time, hence only minimal effort and dexterity is required to install the lace lock 108 and ready it for use:

The arcuate shape of the cord passage 206, extending to the sides and rearwardly from the central area of body 200, acts to separate and guide the two laces towards the entrances of the grip channels 208 in response to the ends of the laces being pulled/tensioned towards the rear of the lace lock, i.e., in the direction towards the grip channels. A transverse dimension/diameter of the shoelace 106 and the narrowest transverse dimension $D_1$ of the grip channels 208 of the lace lock 108 are selected such that the shoelace ends 114 interact with the grip channels substantially as described with reference to FIGS. 3A-3C, i.e., while the shoelace ends are under sufficient tension, they can be easily positioned within the grip channels, but when tension is applied in only one direction the grip channels resist movement of the shoelace ends through the lace lock.

Figure 5:
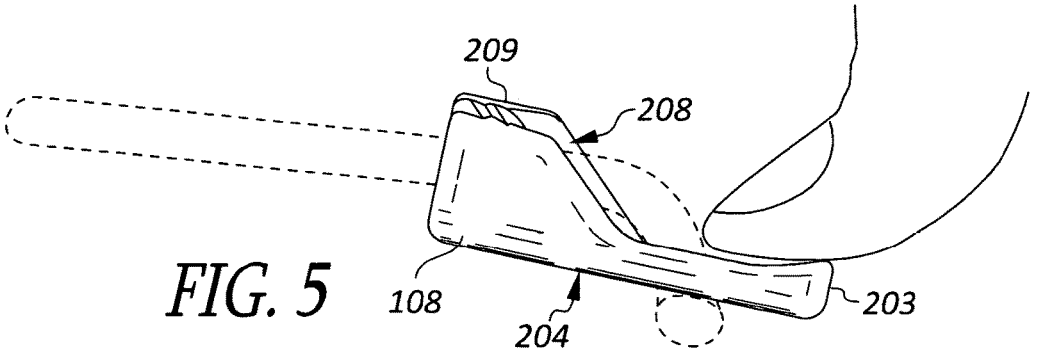
FIG. 5 is a side elevation view showing the lace lock of FIG. 4 in cooperation with a finger of a user during a process of engaging the elastic laces.

FIG. 5 shows the shoelace ends 114 during the process of engaging the lace lock 108. As explained above, in use the user tensions the shoelaces 106 to the desired degree, and the lace lock 108 then engages the shoelaces to prevent loss of tension. Accordingly, to engage the lace lock 108, the user simply grasps the shoelace ends 114 near the end cap 110, and draws the lace ends 106 rearwardly to apply the desired tension to the shoelace. With the other hand, the user concurrently applies downward pressure to the thickened tab 203 at the front of the lace lock 108. As can be seen in FIG. 5, the upwardly sloped surface of the proximally-thickened tab is dimensioned and contoured to be pressed under the thumb of a user's hand. Optionally, the index figure (or other finger) of the same hand may simultaneously contact the lower surface 24 of the lace lock 108 at a more rearward location generally under the area of the grip channels 208*a-b*.

The downward pressure transmitted by the lace lock 108 onto the forward portions of the shoelace ends 114 traps the shoelace ends, while the lace lock tends to pivot, or rotate, under the same pressure, as shown in FIG. 5. While applying the downward pressure, the user pulls the shoelace ends 114*b* in a downward and rearward direction, from the lace lock 108. The rearward/distal force causes the shoelace ends 114*b* to elongate and thin, while the downward force causes the shoelace ends 114 to drop into the grip channels 208. When the shoelace has been tightened and the shoe cinched to the desired extent, the user releases tensioning force on the rearward portions of the shoelace ends 114*a*, which permits the rearward portions of the elastic laces to return to their relaxed state, such that a diameter of the rearward portions of the elastic laces swells to exceed narrowest transverse dimension $D_1$ of the grip channels 208. In this condition, the lace lock 108 resists any loosening of the shoelace 106, substantially as described above with reference to FIG. 3C, holding and maintaining the lace at the desired tension.

As explained above with reference to FIG. 2D, the grip teeth 210 of the grip channels 208 are angled downwardly towards the forward end of the lace lock 108. Thus, while the lace lock 108 is in engagement with the shoelace ends 114*a-b* positioned within the grip channels 208, tension applied to the forward portions of the shoelace ends 114*a* will tend to draw the shoelace ends even more deeply into the channels and tightly against the upper face 202 of body 200, rendering the engagement increasingly secure.

Referring again to FIG. 4, it can be seen that during the engagement process, while the shoelace ends 114 are under tension, the ends of the cord passage 206 serve to position the shoe lace ends directly over/in front of the respective grip channels 208*a-b*, simplifying engagement. The two ends of the arcuate cord passage 206 are preferably located closely proximate to (e.g., within 1-2 mm, and preferably no more than a full diameter of the lace) or contiguous with the forward entrances of the grip channels 208, so that the lace ends enter the grip channels at a comparatively steep angle, hence, the lace ends are more easily pulled deep into the grip channels than if the lace ends were stretched a greater distance from the cord passage and therefore entered the grip channels at a shallower angle. Additionally, the upper and leading surfaces of prominence 110 are contoured to help guide the shoelace ends 114 into engagement as they are tensioned in the manner described above.

To loosen the shoelace—e.g., to remove the shoe—the user again holds the lace lock 108 in one hand and the distal portions 114*b* of the lace ends in the other. The user applies a degree of tension to the lace ends 114 together with a slight upwardly pull, while holding the lace lock steady with the first hand, which results in the lace ends sliding up between the opposed grip teeth 210 of the grip channels 208 and out the tops of the channels. The lace ends 114 are then free to slide through the cord passage 206 of the lace lock 108 so as to loosen the shoe. The release process is thus exceptionally quick and easy to perform and again requires only minimal strength and dexterity on the part of the user.

Turning now to FIGS. 6A-6D, a lace lock 600 is illustrated in accordance with another embodiment of the invention. The views of the lace lock 600 of FIGS. 6A-6D correspond to the views of the lace lock 108 of FIGS. 2A-2D, as described above. Elements and operation of the lace lock 600 are substantially similar, and so will not be described in detail again, although a few distinguishing features will be pointed out.

Figure 6A:
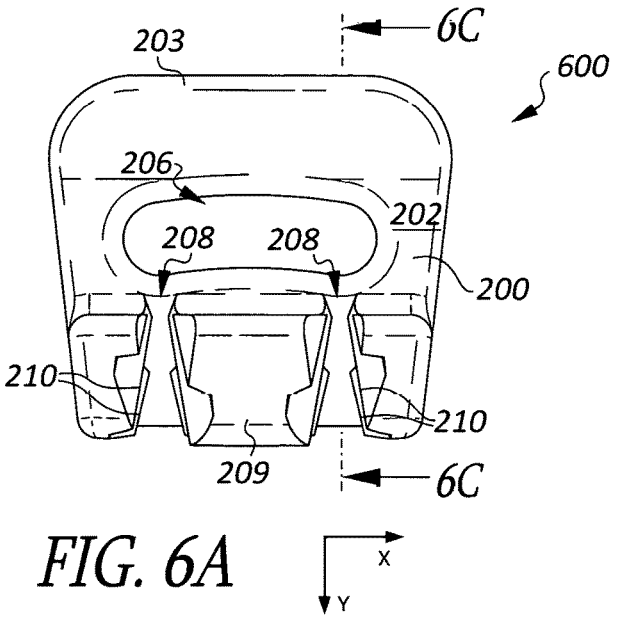
FIGS. 6A-6D are views of a lace lock according to another embodiment of the invention, each view corresponding to a respective one of FIGS. 2A-2D.
Figure 6B:
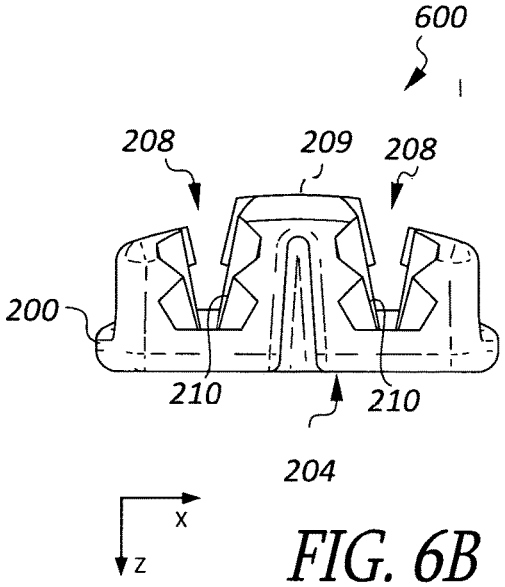
Figure 6C:
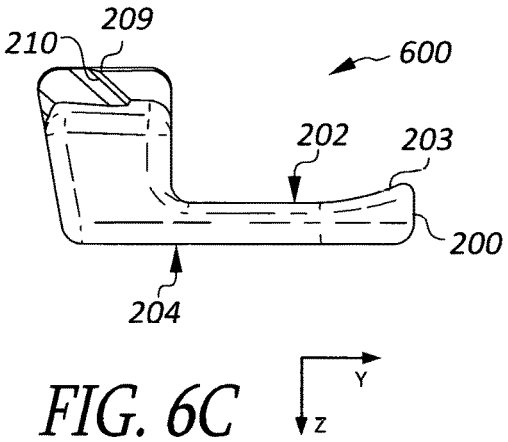
Figure 6D:
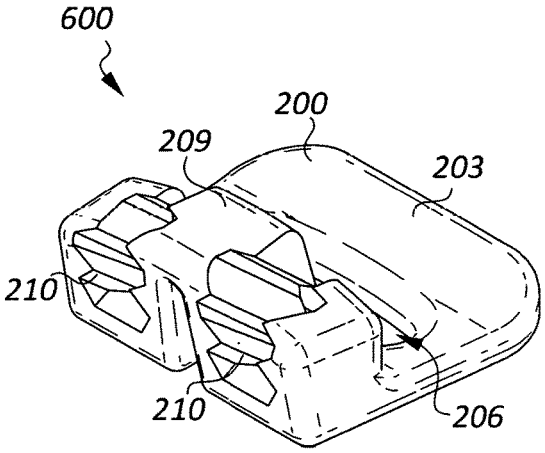

Referring first to FIG. 6A, and comparing this with FIG. 2A, it can be seen that the length of the lace lock 600 is shorter relative to its width. Also, the side view of FIG. 6C shows that the shape of the lace lock 600, and particularly the shape of the portion through which the grip channels 208 pass is changed from that of the lace lock 100 described above. As shown in FIG. 6B, the grip teeth 210 of the lace lock 600 are not only angled downwardly, but also inwardly, so that the narrowest transverse dimension is defined by the distance between a pair of grip teeth 210 at the point where the teeth meet the upper face of the body 200.

Because the grip teeth 210 of the lace lock 600 are angled inward, tension tending to loosen a shoelace will draw the shoelace ends 114 downwardly into the narrower portions of the grip channels 208, which significantly increases the strength of the engagement. Thus, the grip channels 208 can be shorter without significant loss of effectiveness.

The embodiment of FIG. 1 shows the lace lock 108 used with a shoe lacing system and oriented such that the lace ends 114 extend forward, with the extreme ends and end cap 110 lying over the laces 106 of a shoe. Subsequent embodiments and descriptions are disclosed in the context of a similar application and orientation. However, this orientation and use are merely provided as an example. Other orientations and uses are contemplated.

Figure 7:
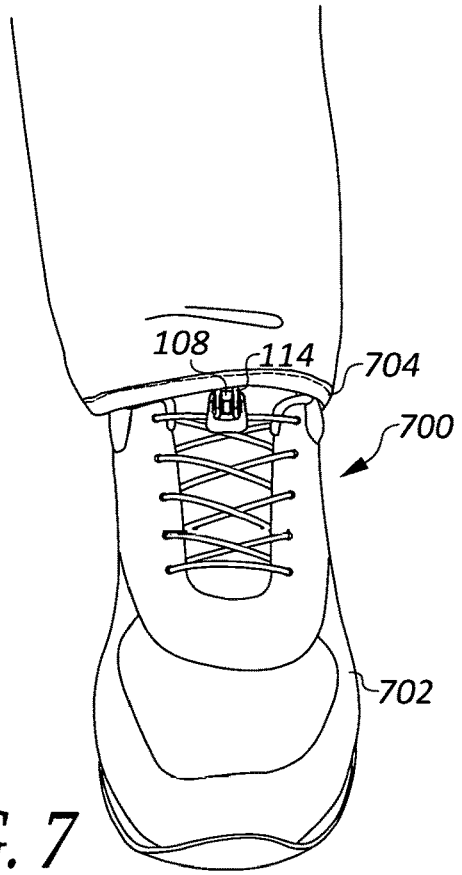
FIG. 7 is a perspective view showing a lace lock system 700, according to an embodiment.

For example, FIG. 7 is a perspective view showing a lace lock system 700, according to an embodiment, in which a lace lock 108 is oriented in a direction opposite that shown in the system 104 of FIG. 1. In the system 700, the extreme ends of the lace ends 114 extend upward, away from the shoe 702 so that they are substantially covered by the user's trouser cuff 704. Some users may prefer this arrangement as presenting a neater appearance.

Figure 8:
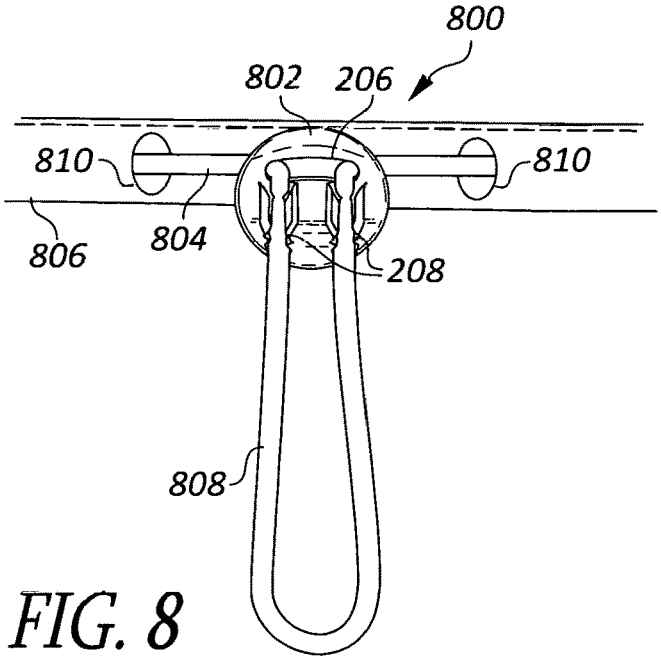
FIG. 8 is a side elevational view of a cord tensioning system 800, according to an embodiment.

FIG. 8 is a side elevational view of a cord tensioning system 800, according to an embodiment. The cord tensioning system 800 includes a lace lock 802 in use to control tension on a cord 804 extending through a hem 806 of a garment, such as a jacket. In the embodiment shown, the lace lock 802 has a round shape, but otherwise includes elements described with reference to other embodiments, including a cord passage 206 and grip channels 208. The cord 8804 is threaded inside the hem 806, with a loop 808 of the cord passing outside the hem between a pair of apertures 810 in the fabric of the hem. The loop 808 passes up through the cord passage 906, then each side of the loop passes through a respective one of the grip channels 208. To adjust the tension of the cord 804, a user grasps the end of the loop 808 with one hand and the lace lock 802 with the other hand. To tighten the cord 804, the user pulls the loop 808 away from the lace lock 802 while keeping the sides of the loop inside the grip channels 208, stretching and thinning the cord 804, until a desired tension is reached, then releases the loop while holding the lace lock in place. To release the tension, the user again pulls the loop 808 away from the lace lock 802 until the cord 804 is sufficiently thinned, then slides the lace lock some distance towards the loop and away from the hem 806, then releases first the loop, then the lace lock. When the lace lock 802 is released, the portion of the cord 804 between the lace lock and apertures 810 is pulled back into the hem 806 by the elastic tension of the cord, reducing the overall tension.

Figure 9:
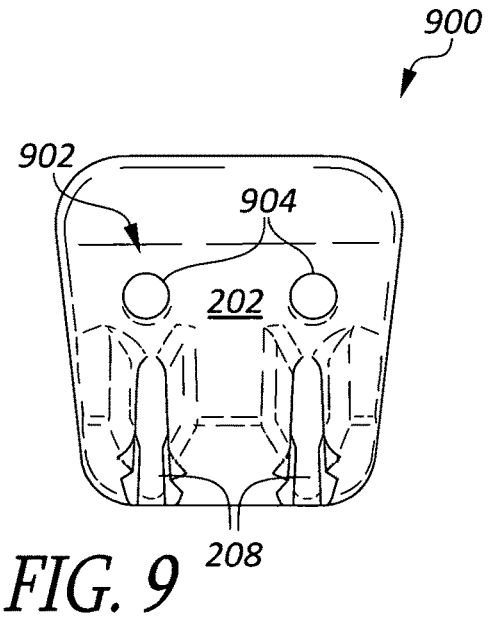
FIG. 9 is a top plan view of a lace lock 900 according to an embodiment.

FIG. 9 is a top plan view of a lace lock 900 according to an embodiment. The lace lock 900 is substantially similar in structure and operation to other embodiments disclosed, but in this embodiment a cord passage 902 is separated into two approximately circular passages 904, each configured to receive a respective lace end or loop side, etc.

Embodiments that employ a lace or cord lock in accordance with the principles disclosed herein have a number of advantages over conventional locking systems. Typical known cord locking clamps include a spring-loaded plunger that applies pinching force to a pair of laces or cords. In order to tighten or loosen the cord, a user presses a button with a thumb to overcome the spring tension and permit movement of the mechanism. It can be recognized that such conventional system and devices can pose difficulties for many users and that they also share inherent limitations. For example, manipulating moving parts can be difficult for users who have conditions that make fine motor actions difficult or painful, such as arthritis, etc. Children may also struggle with conventional locking clamps because of the level of dexterity and/or hand strength required. Additionally, typical locking clamps tend to slip as tension increases, so the tension they can hold is limited. To achieve a strong tension, the loading spring must be made stronger, which then requires greater force on the part of the user to release.

In contrast, the lace locks of the systems described herein have no moving parts that require manipulation and a user employs primarily the muscles of the arm to engage to disengage the device, rather than the weaker muscles of the thumb and fingers. Furthermore, they are capable of securing a cord against a much higher tension, enabling their use in applications where a relatively high tension is required. Finally, lace locks according to the disclosed embodiments can be manufactured in a single molding or casting process, whereas the known systems require the manufacture and assembly of multiple parts, which makes them more expensive to produce and more prone to breakage.

The use of positional terms such as top, bottom, upper, lower, front, back, side, etc., is for convenience and clarity in describing and defining features and elements of the various embodiments. Likewise, arrows indicating X, Y, and/or Z axes are provided in some of the drawings to aid a viewer in recognizing the relationships of the drawings with each other. Neither the positional terms used nor the axes defined in the drawings is intended to suggest any necessary orientation of physical structures or processes on which the claims read. Accordingly, unless defined otherwise, the claims can be read on any structure or method that otherwise meets the limitations of the claim language, without regard to orientation.

The abstract of the present disclosure is provided as a brief outline of some of the principles of the invention according to one embodiment, but is not intended as a complete or definitive description of any single embodiment thereof, nor should it be relied upon to define terms used in the specification or claims. The abstract does not limit the scope of the claims.

Various changes can be made to the disclosed embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A device, comprising:

a body, having:

an upper face, a lower face on a side of the body opposite the upper face, a front body end, and a rear body end on an end of the body opposite the front body end;

a cord passage extending through the body between the upper face and the lower face;

a first grip channel formed on the upper face and having a first end adjacent to the cord passage and a second end adjacent to the rear body end, the first grip channel having a first pair of grip teeth facing each other on opposite sides of the first grip channel, ridges of the first pair of grip teeth extending, in the first grip channel a rear-to-front, downward angle, such that the ridges are closest to the rear body end at their uppermost ends, while the ridges are closest to the front body end at their lowermost ends, where they terminate against the upper face; and a second grip channel formed on the upper face substantially parallel to the first grip channel and having a first end adjacent to the cord passage and a second end adjacent to the rear body end, the second grip channel having a first pair of grip teeth facing each other on opposite sides of the second grip channel, ridges of the first pair of grip teeth extending, in the second grip channel, at a rear-to-front, downward angle, such that-the ridges are closest to the rear body end at their uppermost ends, while the ridges are closest to the front body end at their lowermost ends, where they terminate against the upper face.

2. The device of claim 1, wherein:

the first grip channel has a plurality of pairs of grip teeth, including the first pair of grip teeth of the first grip channel; and the second grip channel has a plurality of pairs of grip teeth, including the first pair of grip teeth of the second grip channel.

3. The device of claim 1, wherein a distance between the ridges of the first pair of grip teeth of the first grip channel to a smallest dimension where the ridges terminate against the upper face.

4. The device of claim 1, wherein the cord passage has an arcuate shape with ends of the cord passage lying adjacent to the first ends of the first and second grip channels, respectively.

5. The device of claim 1, wherein a smallest distance between the ridges of the first pair of grip teeth of the first grip channel defines a minimum channel dimension.

6. The device of claim 5, comprising:

a first elastic cord extending through the cord passage and along the first grip channel and having a transverse dimension, while relaxed, that is greater than the minimum channel dimension; and a second elastic cord extending through the cord passage and along the second grip channel and having a transverse dimension, while relaxed, that is greater than the minimum channel dimension.

7. The device of claim 6, wherein the first and second elastic cords are first and second ends of a shoelace, respectively.

8. The device of claim 6, wherein the first and second elastic cords are first and second sides of a loop, respectively.

9. The device of claim 1, wherein a thickness of the body between the upper and lower faces is greater adjacent to the front body end than at the cord passage.

10. The device of claim 1, wherein the lower face is substantially planar.

* * * * *